United States Patent [19]

Bagwell, Jr.

[11] Patent Number: 4,693,167

[45] Date of Patent: Sep. 15, 1987

[54] STRAP FOR LINKED CONTAINER ARTICLE CARRIER

[75] Inventor: Charles Bagwell, Jr., Tallahasseė, Fla.

[73] Assignee: Howden Coloney, Inc., Tallahasse, Fla.

[21] Appl. No.: 715,322

[22] Filed: Mar. 25, 1985

[51] Int. Cl.[4] ..... F42B 39/08

[52] U.S. Cl. ..... 89/35.01; 139/390; 206/443

[58] Field of Search ..... 89/35.01; 139/390; 206/443; 428/188, 257, 258

[56] References Cited

U.S. PATENT DOCUMENTS

| | | | |
|---|---|---|---|
| 735,757 | 8/1903 | Grubbs | 89/35.01 |
| 1,136,956 | 4/1915 | Henneveld et al. | 89/35.01 |
| 1,247,810 | 11/1917 | Frissell | 89/35.01 |
| 1,346,207 | 7/1920 | Jennings | 89/35.01 |
| 1,346,208 | 7/1920 | Jennings | 89/35.01 |
| 2,061,072 | 11/1936 | Hendley | 89/35.01 |
| 2,337,657 | 11/1940 | Hendley | 89/35.01 |
| 2,342,802 | 2/1944 | Hendley | 89/35.01 |
| 2,350,457 | 6/1944 | Hendley | 89/35.01 |
| 2,350,752 | 6/1944 | Graf | 139/390 |
| 2,972,000 | 2/1961 | Boriolo | 139/390 |
| 4,090,002 | 5/1978 | Rosenblum | 428/258 |
| 4,137,821 | 2/1979 | Benedict | 206/443 |
| 4,205,709 | 6/1980 | Duschek | 138/390 |
| 4,385,696 | 5/1983 | Benedict et al. | 206/443 |

*Primary Examiner*—Stephen C. Bentley
*Assistant Examiner*—Stephen M. Johnson
*Attorney, Agent, or Firm*—Dowell & Dowell

[57] ABSTRACT

An improved strap for linking ammunition and similar article carrier tubes in which the strap includes two warps which alternately form the top and bottom layers of a double fabric so as to form successive connected loops or pockets of a predictable pitch and/or length dimension and wherein a separate weft or woff filler material is interwoven to bind the warp materials with such weft being less dense in the area adjacent the cross-over points between the warp layers so that the two warps can be expanded or moved longitudinally relative to one another adjacent spaced intersections of the loops so as to permit a limited enlargement of the spaced loops.

10 Claims, 12 Drawing Figures

STRAP FOR LINKED CONTAINER ARTICLE CARRIER

BACKGROUND OF THE INVENTION

This invention is generally directed to flexible straps for use in connecting a series of linked tubes in which ammunition or other articles may be supported and conveyed and more specifically to an improved strap having two warps which alternately pass through one another to form a series of pockets or loops so that each warp alternately forms the top and bottom layer of a double fabric and wherein the warp materials are bound by a weft filler material which extends generally perpendicularly with respect to the warp materials except in the area of the crossover points between the two warps to thereby permit a limited movement of the two warps relative to one another at the points of crossover. The weave pattern is preferably such that each warp alternately forms the upper or lower fabric of two adjacent loops with the warps being united as a single fabric layer at the intersections thereof intermediate each crossover point.

History of the Prior Art

Heretofore there has been a great deal of inventive effort directed to designing conveyor systems for handling elongated articles such as ammunition used in automatic weapon systems. In U.S. Pat. No. 4,137,821 to Benedict, an article handling belt is disclosed which provides a plurality of generally parallel disposed containers for handling elongated articles and especially for ammunition in the 20–40 mm size range. The containers are in the form of tubular sleeves which are connected in a belt like configuration by a plurality of flexible webs so that they are maintaned as closely as possible in constant pitch and distance relationship with respect to their longitudinal axes. The patent further discloses a number of web materials used to connect the containers. These web materials are disclosed in several configurations including both round and flat materials which are formed into the shape of a figure eight (8) or in the form of separate circles which are connected by a separate material link.

In U.S. Pat. No. 4,385,696 to Benedict et al., there is disclosed an improved structure for flexible nonexpandable belts or straps which are used to maintain a plurality of generally parallel containers in a predetermined relationship with respect to one another. In this patent, the belts are constructed of a nonexpandable continuous filament material which is encased within a flexible adhesive.

The aforementioned strap or belt constructions for connecting generally parallel disposed containers and especially for use in high-speed ammunition transfer and handling systems, such as aircraft loading systems, have not proved to be completely satisfactory and may even fail after a period of time. In prior art structures where the strap is connected by friction snaps directly to the article carriers, the connection between the straps and the carriers may be accidentally disengaged during use. Such straps also suffer from wear after repeated use in loading and unloading ammunition systems. In other strap constructions, it has been found that a crimp can be introduced into the continuous nonexpandable filament material during manufacture. The crimp in the continuous filament can ultimately result in a pitch variation between the containers of a loading or similar system. Due to this problem, government specifications specifically direct a limited cycling time for straps used with linked ammunition containers so that the problem of pitch variation will not be encountered during use of the ammunition containers linked by such belts.

SUMMARY OF THE INVENTION

This invention is directed to a design for a new strap for use in linking ammunition tube carriers so as to offer a more predictable and accurate carrier pitch between adjacent tubes while permitting flexibility of the strap and external shifting between carriers wherein the strap is constructed of a woven fabric tape having two warps which alternately form the top and bottom layers of a double fabric and wherein the warps alternately intersect with one another to form pockets or rings of predictable size with each warp crossing over or through the other warp at every other intersection so that each warp successively forms the upper fabric of two adjacent loops and then the lower fabric of two adjacent loops. Each warp is bound by a weft material with the density of the weft material being reduced in the area of the crossovers between the first and second warps so that each warp is permitted limited sliding movement relative to the other warp at the area of the crossover.

It is the primary object of this invention to provide a strap for use in connecting a series of tubes to form a linked tube ammunition carrying system in which the strap is formed of a woven double layer fabric consisting of two overlapping warps which intersect one another at generally equally spaced points along the length of the strap so as to form circles, loops, or pockets in which the tube carriers may be selectively supported.

It is another object of the present invention to provide a woven fabric tape for use as a strap for connecting tubular ammunition or other article carriers wherein the tape is formed of two overlapping warps which alternately intersect one another to form a series of loops or pockets in which the tubular carriers are supported and which warps are bound by a weft material except at the area adjacent every other intersection between the warps.

It is a further object of the present invention to provide a woven fabric tape for use as a strap in connecting tubular ammunition carriers which is formed of two overlapping warps which alternately intersect with one another along the length of the strap and wherein each warp is constructed in such a manner that the two warps may be moved longitudinally with respect to one another for a limited distance at the point of every other intersection between such warps.

It is yet another object of the present invention to provide a woven fabric tape for use as a strap in connecting tubular 30 mm ammunition carriers where the tape is formed of two overlapping warps which alternately intersect with one another to form a series of loops or circles in which the article carriers may be selectively supported and in which such loops allow for limited lateral flexibility to permit the article carriers to be cammed relative to one another during passage of the linked tube carriers through ammunition transfer and loading systems.

It is a further object of the invention to provide an improved strap for use with linked tube ammunition carriers wherein the strap exhibits increased durability while insuring for the proper pitch and alignment between adjacent tubes.

It is a further object of the invention to provide a woven tape for use as a strap in connecting tube carriers in which the woven tape is formed of two alternately intersecting warps which form a series of loops or circles and wherein each warp successively forms either the top or bottom fabric layers of the loops and thereafter crosses over to form the opposite layer at various points and preferably at every other intersection therebetween so that the loops may be expanded by limited movement of the warps at the points of crossover therebetween so as to permit the tape to be fully or semiautomatically positioned in engagement with tubular ammunition or other article carriers.

DESCRIPTION OF THE PREFERRED EMBODIMENT

Figure 10:
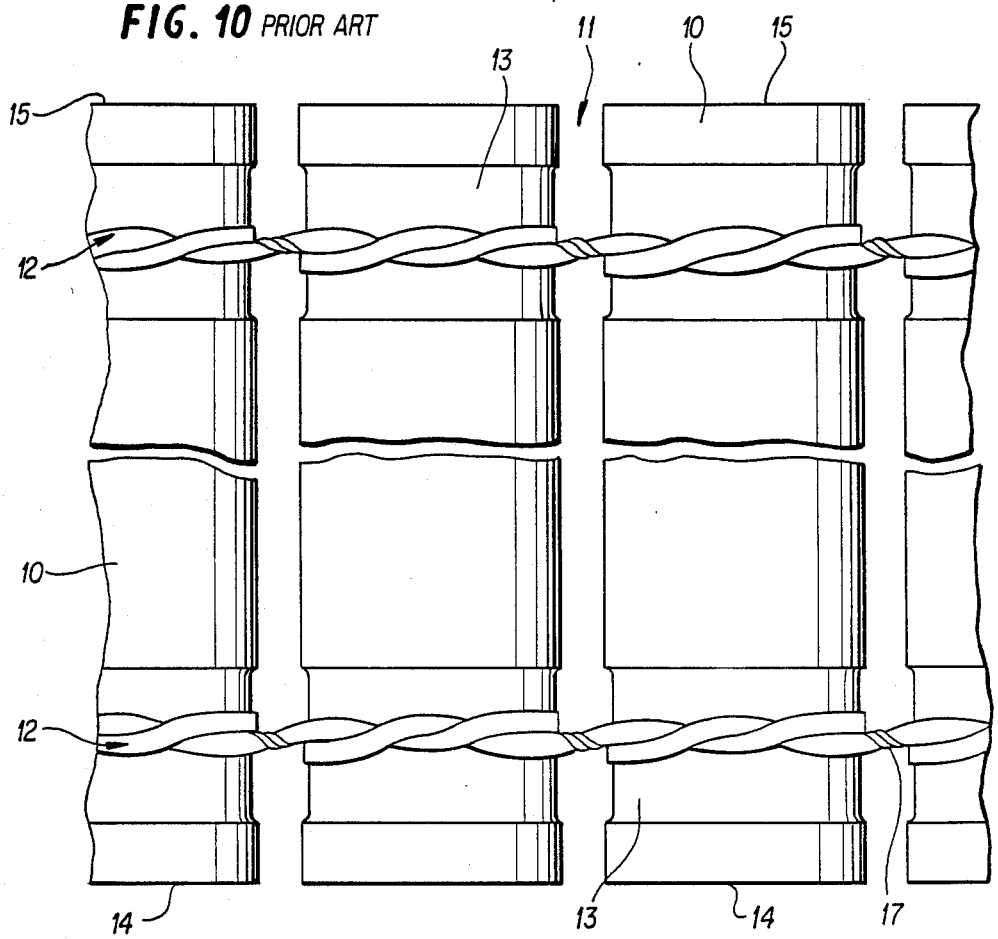
FIG. 10 PRIOR ART
FIG. 10 is a top plan view illustrating a prior art linked tube article carrier having a connecting strap of a different construction.
Figure 11:
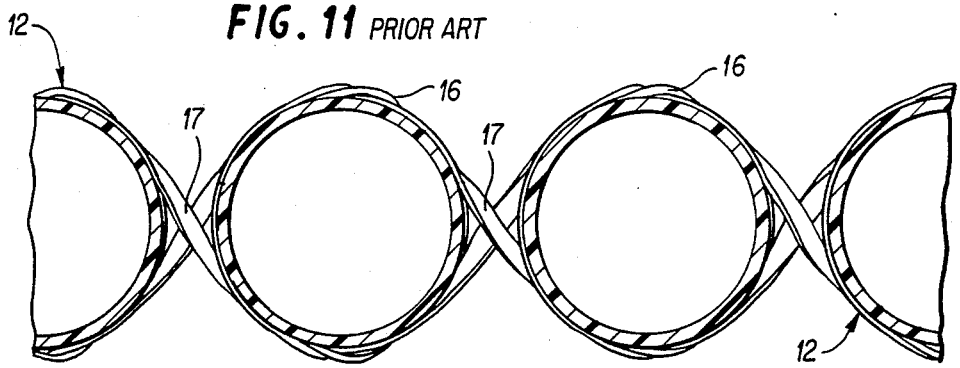
FIG. 11 PRIOR ART
FIG. 11 is a sectional view taken along lines 11—11 of FIG. 10.
Figure 12:
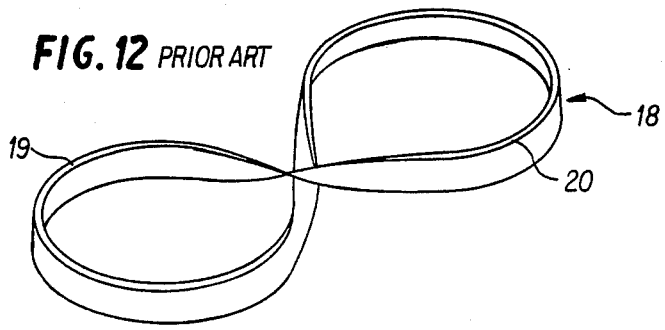
FIG. 12 PRIOR ART
FIG. 12 is a perspective view of another form of prior art strap for use in connecting tubes in linked tube article carrier systems.

With particular reference to FIGS. 10–12 of the drawings, there are disclosed two types of connecting straps conventionally used in linked ammunition carrier systems. In the prior art structures shown, the straps are of a particular design for use in assembling a plurality of generally parallel disposed article carrier containers 10 in a flexible belt like configuration 11 as shown by the illustration of FIG. 10. The particular containers shown in FIG. 10 have specific utility with regard to ammunition loading systems which are particularly adaptable for carrying rounds of ammunition, such as 30 mm ammunition, to supply fresh rounds of ammunition to and remove spent casings from the ammunition conveyor system of a military aircraft.

The prior art ammunition containers 10 are shown as being connected by a pair of belts 12. The containers are provided with a pair of spaced annular grooves 13 located adjacent the opposite ends 14 and 15 of the containers. The belts 12 are constructed as generally flat bands which include a plurality of strands of a flexible substantially continuous filament which exhibits a low percentage of elongation such as an aramid filament. The substantially nonexpandable filaments are bonded by a thermoplastic heat sensitive adhesive such as polyamide hot melt adhesive which is generally flexible at normal temperatures and which exhibits a low coefficient of friction so that the belts may be moved easily relative to the containers. Each of the belts 12 is formed into an elongated loop 16 which is twisted into a figure eight (8) configuration to form a pair of loops connected by twisted portion 17. Each of the loops 16 is spaced apart and is of a size to form a circle which receives the annular grooved portion 13 of the containers 10. In order to increase or decrease the size of the loops of the belts 12, it is necessary that the loops be moved relative to one another so that as a loop around one container is decreased in size any slack can be taken up by the figure eight (8) portion around the adjacent container.

A second type of prior art strap 18 used in linked tube article carrier systems is shown in FIG. 12. This strap consists of a generally flat band of material which is formed into a figure eight (8) configuration. The strap 18 is cut at a predetermined length after which the material is twisted and the ends joined together to form a double twist closed circle. The circle is thereafter twisted to form a pair of loops 19 and 20 of a size to receive the ends of a pair of adjacent article carriers. As with the prior art straps shown in FIGS. 10 and 11, the adjacent circles 19 and 20 of the strap 18 may only be expanded relative to one another by closing one circle and drawing the excess material into the adjacent loop. Due to the twisted configuration of the strap 15, once the strap is placed on the ammunition carrier such adjustment or movement of adjacent circles is extremely difficult.

Figure 1:
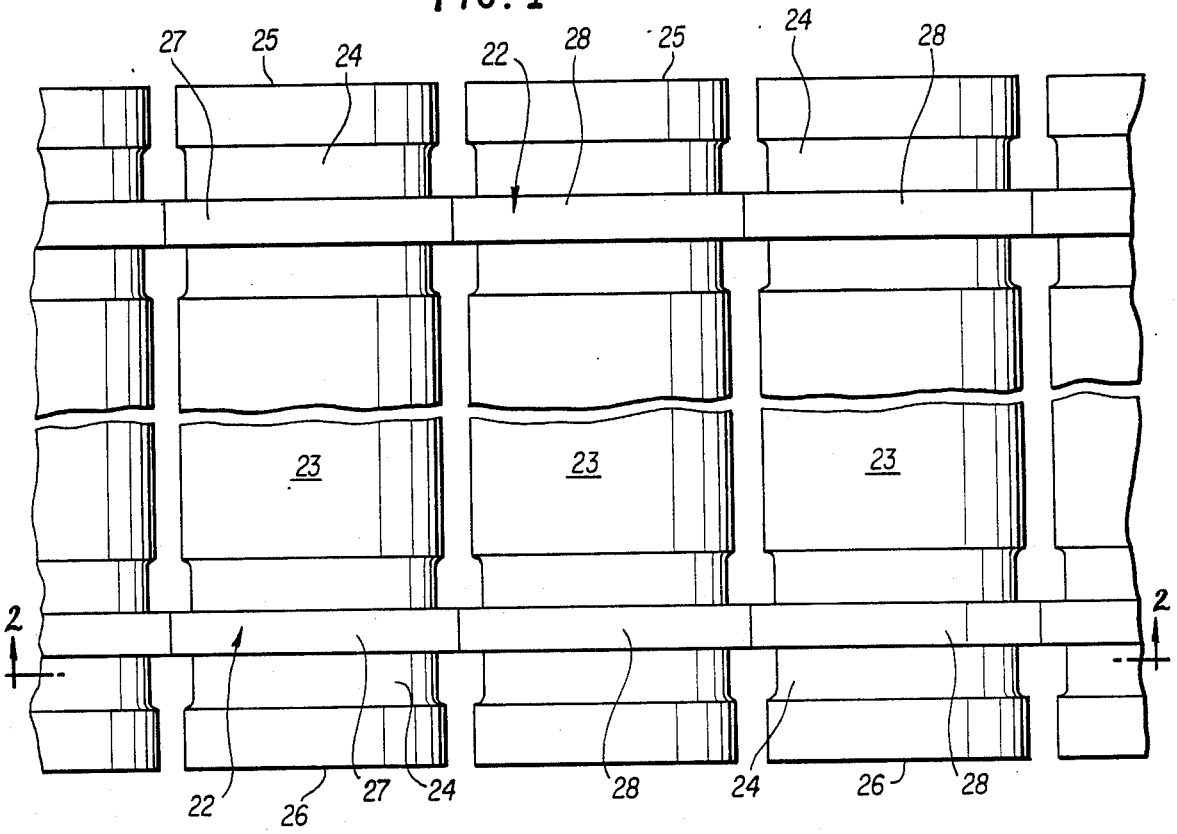
FIG. 1 is a top plan view showing a series of article carriers which are linked using the woven tape of the present invention.
Figure 2:
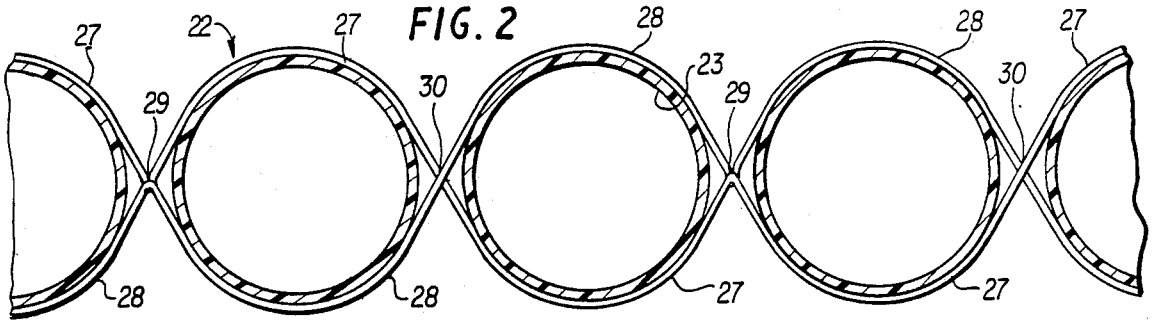
FIG. 2 is a cross-sectional view taken along lines 2—2 of FIG. 1.

With particular reference to FIGS. 1 and 2, the improved strap 22 of the present invention is shown as it is used to connect a plurality of containers 23 which are disposed generally parallel with respect to one another. As with the prior art containers, the containers 23 are formed with a pair of annular grooves 24 which are spaced apart from one another and adjacent each of the ends 25 and 26 of each article carrier tube 23. As opposed to the general solid construction of the prior art straps, the present strap 22 is constructed of first and second woven warps 27 and 28 which intersect each other at spaced points 29 and 30 along the length of the tape 22. Each warp 27 and 28 is similarly constructed and may include a pair of colored tracer yarns 31 along the edges thereof. Generally, the tracer yarns of the warps will be differently colored or marked in order to visually facilitate assembly or use of the strap in the field. The yarns 31 and 32 used in forming each warp are constructed of conventional industrial type polyester having sufficent strength to resist failure or stretching during use. In some instances, one or more aramid fibers such as Kevlar may be incorporated into the warp yarns to give additional strength to the strap.

To bind the warp materials of the strap together, wefts or woffs 33 and 34 are formed using the same material as used in the warps. During construction of the strap, the weft materials are extended back and forth in generally perpendicular relationship to the warp materials.

Figure 7:
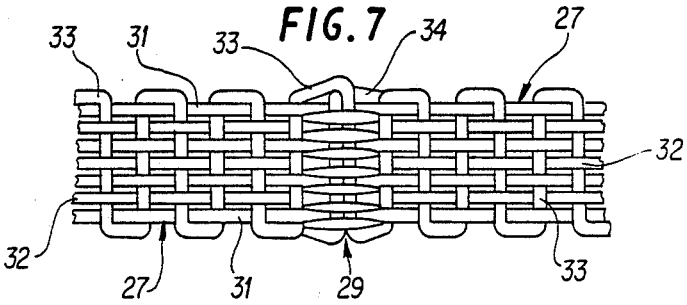
FIG. 7 is an enlarged top plan view of a portion of the strap of the present invention showing the warp and weft pattern at a non-crossing intersection between the two warps.
Figure 8:
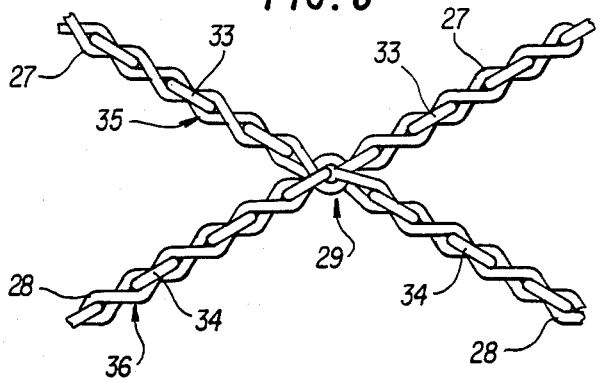
FIG. 8 is an enlarged front plan view showing the woven fabric of the strap at a non-crossing intersection as shown in FIG. 7.

As previously discussed, the strap of the present invention is constructed of two separate warps 27 and 28 which intersect each other at spaced points 29 and 30. As shown in FIG. 8, at the point of inersection 29, the warps are interwoven as a single fabric layer however, as shown in FIG. 7, the warps do not actually cross one another at these points. The points of intersection designated as 29 will be referred to as non-crossing intersections as the warp 27 remains the upper fabric layer while the warp 28 serves as the lower fabric layer of the strap on either side of such intersections as shown in FIGS. 2 and 7.

As shown in FIGS. 7 and 8, at the non-crossing intersections 29, the weft threads or yarns 33 and 34 are tightly bound in generally close proximity to one another just as they are along the length of each warp layer. In this manner, adjacent loops are retained in accurate alignment to insure the carrier or tube pitch between adjacent fabrics which are supported by the strap during its use.

Figure 3:
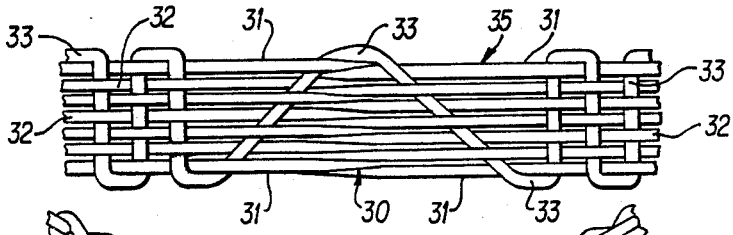
FIG. 3 is an enlarged top plan view of a portion of the woven fabric strap of the present invention showing the point of the crossover between the two warps.
Figure 4:
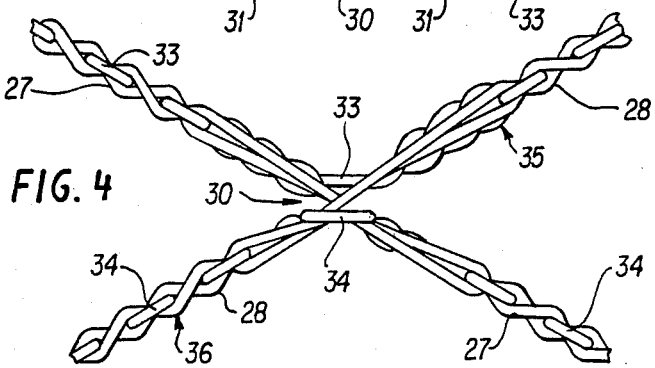
FIG. 4 is an enlarged front plan view showing the woven fabric of the strap at the point of a crossover intersection between the two warps as shown in FIG. 3.

As shown in FIGS. 3 and 4, at the point of intersection 30, the warps are loosely woven by the weft materials 33 and 34 and the warp threads actually cross over to opposite sides of the strap. The loose or less dense weft material 33 and 34 at the cross over intersections 30 permit the strap to be more flexible and allow for relative movement of the warp threads forming adjacent loops so as to permit containers or tubes carried by the straps to be shifted laterally during use.

In order to permit a relative sliding movement between the warps 27 and 28, the wefts 33 and 34 are modified at the points of the intersection 30 between the warps. As shown in FIG. 3, at the crossover points of the intersection 30, the weft materials are extended generally diagonally with respect to the length of the strap as opposed to being generally perpendicularly oriented throughout the remainder of the strap. As the warp threads are loosely bound, they may be shifted or moved relative to one another before engaging the closely knit wefts which bind the warp materials at points spaced on either side of the intersections 30, as shown in dotted lines in the schematics of FIG. 5. This limited movement permits expansion of the adjacent circles or loops which are formed by the interwoven warps. In practice, the effect of the generally open wefts at the crossover points of the intersection 30 is to permit a sliding action relative to the two warps of approximately $\frac{1}{4}$ to $\frac{1}{2}$ inch.

With reference to FIG. 4, it should be noted that the weft materials 33 and 34 woven into the warps do not extend through the crossover points or intersections 30 between the warps. The strap is formed with the warps alternating as top and bottom layers of the strap with one weft material 33 extending along the top layer 35 and the other 34 extending along the bottom layer 36. In this manner, the weft materials are alternately woven to each of the warps 27 and 28 respectively. The weft materials are, therefore, shown in FIG. 4 at crossover point 30 as being generally parallel with one another and extending to the adjacent warp at such point of intersection.

In practice, the strap 22 of the present invention is formed so as to create a series of adjacent loops or circles having their centers spaced apart a distance slightly greater than the diameter of the containers 23. The strap 32 may be formed having a width of approximately $\frac{1}{4}$ to $\frac{3}{8}$ inches with the length of each warp between adjacent intersections being approximately 3.125 inches. In use, the strap may be automatically or semiautomatically placed around the grooved portions 24 of the article carriers 23. As the warps are free or loosely bound by the weft filling yarns at each crossover intersection between the adjacent circles or loops of the strap, the loosely bound area will allow each loop or pocket to expand at the time of the assembly of the strap with the generally parallel containers. In addition, during the use of the linked tube carriers using the straps of the present invention, the bound areas between the warps represented by the non-crossover intersections 29 will permit the tubes to remain in a proper pitch with respect to one another as such tubes are carried around circular sprockets and drums. The crossover intersections will permit the tube carriers to be shifted laterally with respect to one another during camming of the tubes as the linked tube carrier belt is introduced through the appropriate handling and loading systems.

Figure 5:
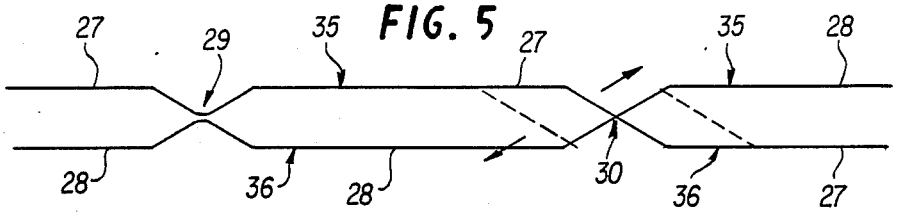
FIG. 5 is a schematic illustration showing the extent of the essentially unbound area between the two warps of the present invention which permits a shifting movement between the dotted lines shown in the drawing which represent a crossover point therebetween.
Figure 6:
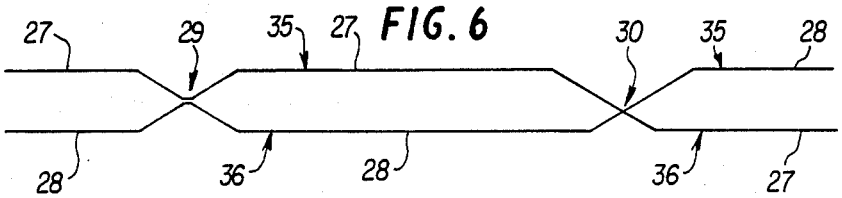
FIG. 6 is a schematic illustration showing the upper warp shifted to the left dotted line position shown in FIG. 5.

As is apparent from FIGS. 5 and 6 of the drawings, the loosely bound crossover areas or intersections 30 between the warps of the new strap permit limited sliding movement of each warp relative to the other with the remainder of the bound filling yarn created by the weft threads 33 and 34 limiting the extent of such movement as shown by the dotted lines in FIG. 5. Warp 27 is shown as being shifted to the left with respect to warp 28 in FIG. 6. The amount of the loosely bound warps at the crossover can be increased or decreased depending upon the particular purpose for which the strap is to be used and the degree of flexibility and adjustability which is necessary to retain adjacent article carriers in a properly aligned position with respect to one another. At the same time, the closely wefted non-crossing intersections will insure stability in pitch of the tubes carried by the straps during its use.

Figure 9:
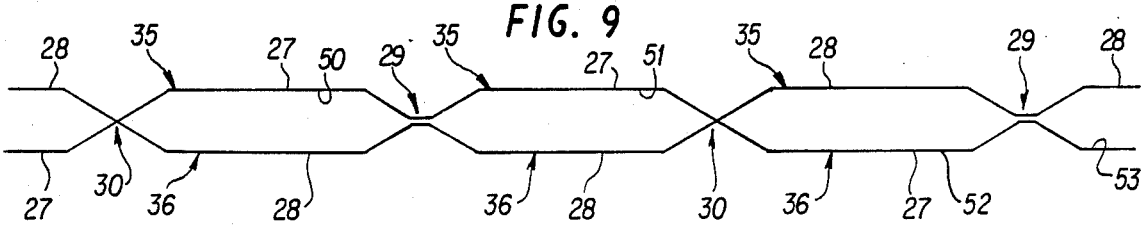
FIG. 9 is a schematic showing the weave pattern of the warps of the present invention showing that each warp alternately forms the upper and the lower fabric layers of pairs of adjacent loops.

With particular reference to FIG. 9, the weaving pattern of the fabric layers of the present invention is schematically disclosed. In looking at the schematic from left to right, the upper warp 27 forms the upper fabric layer of the strap defining the first two loops or pockets designated as 50 and 51. Thereafter, warp 27 crosses over or through warp 28 at intersections 30 and then defines the lower fabric layer of the strap defining the third and fourth loops 52 and 53. Thus warp 27 then passes through another crossover intersection (not shown) and is oriented as the upper fabric layer once again. Thus, the weave pattern extends over a length of four (4) loops or pockets.

I claim:

1. A woven strap for use in connecting a plurality of generally parallel disposed tubular carriers comprising first and second material warps which engage with one another at spaced points of intersection along their length, each of said first and second material warps having a plurality of individual filaments which extend generally longitudinally of the strap, a series of loop means formed between said first and second material warps and between adjacent points of intersections of said first and second material warps, each of said loop means having upper and lower material layers, said first and second material warps crossing through one another at a predetermined number of said spaced points of intersection of said first and second material warps so that each of said plurality of filaments of said first and second material warps will alternately form portions of the upper and lower material layers of said loop means, each of said first and second material warps being normally firmly bound by weft material which extends back and forth generally perpendicularly with respect thereto and which are spaced apart a first closely spaced distance, said first and second material warps being loosely bound by said weft material which is spaced apart a second preselected distance greater than said first closely spaced distance adjacent to said predetermined number of spaced points of intersection of said first and second material warps so that said weft material may be extended relatively diagonally with respect to said first and second material warps whereby said first and second material warps are longitudinally moveable with respect to one another adjacent each of said predetermined number of spaced points of intersection thereof so as to permit said loop means adjacent thereto to be expanded relative to one another.

2. The woven strap of claim 1 in which said points of intersection of said first and second material warps other than said predetermined number are points at which said first and second material warps are interwoven as a single material layer without crossing over to form an opposite material layer of said upper and lower material layers of said loop means.

3. The woven strap of claim 2 in which said predetermined number of said spaced points formed by an intersection of said first and second material warps beween said first and second material warps so that said first and second material warps alternately form the upper and lower material layers of two consecutive loop means.

4. The woven strap of claim 3 including upper and lower weft materials, said upper weft material binding said upper material layer of said loop means and said lower weft material binding said lower material layer of said loop means.

5. The woven strap of claim 4 in which said first and second material warps are longitudinally moveable with respect to one another at said predetermined number of spaced points of intersection of said first and second material warps between approximately $\frac{1}{4}$ to $\frac{1}{2}$ inch.

6. The woven strap of claim 4 in which each of said first and second material warps includes a pair of outermost filaments, each of said outermost filaments being selectively colored so that the outermost filament of said first material warp.

7. The woven strap of claim 6 in which each of said first and second material warps and said weft material is formed of polyester fibers.

8. A woven strap for linking a plurality of ammunition supply containers in generally parallel relationship comprising first and second material warps which intersect with one another at a plurality of first and second spaced intesections along their length, a series of loop means formed by said first and second material warps and between adjacent intersections of said first and second material warps, each of said loop means having upper and lower material layers, said first and second material warps crossing through one another at said first spaced intersections so as to alternately form portions of the upper and lower material layers of said loop means, each of said first and second material warps being normally firmly bound by weft material which extends back and forth generally perpedicularly with respect thereto and which are spaced apart a first closely spaced distance, said first and second material warps being loosely bound by said weft material which is spaced apart a second predetermined distance greater than said first closely spaced distance in the area of said first spaced intersections of sa&d first and second material warps so that said weft material may be extended relatively diagonally with respect to said first and second material warps whereby said first and second material warps are longitudinally moveable with respect to one another adjacent each of said first intersections thereof so as to permit said loop means adjacent thereto to be expanded relative to one another.

9. The woven strap of claim 8 in which said first and second material warps are interwoven as a single material layer at each of said second spaced intersections without crossing over to form an opposite material layer of one of said upper and lower material layers of each of said loop means.

10. The woven strap of claim 9 in which said first and second spaced intersections are spaced beween one another so that said first and second material warps alternately form the upper and lower material layers of two consecutive loop means.

* * * * *